US008833612B2

(12) United States Patent
Inaba et al.

(10) Patent No.: US 8,833,612 B2
(45) Date of Patent: Sep. 16, 2014

(54) FIXED QUANTITY DISCHARGE SQUEEZE CONTAINER

(75) Inventors: Shinichi Inaba, Sumida-ku (JP); Hiroshi Goto, Sumida-ku (JP); Michiaki Fujita, Sumida-ku (JP); Mitsugu Iwatsubo, Sumida-ku (JP)

(73) Assignee: Kao Corporation, Tokyo (JP)

( * ) Notice: Subject to any disclaimer, the term of this patent is extended or adjusted under 35 U.S.C. 154(b) by 0 days.

(21) Appl. No.: 13/510,812

(22) PCT Filed: Nov. 12, 2010

(86) PCT No.: PCT/JP2010/070172

§ 371 (c)(1), (2), (4) Date: Jul. 12, 2012

(87) PCT Pub. No.: WO2011/062115

PCT Pub. Date: May 26, 2011

(65) Prior Publication Data

US 2012/0267397 A1 Oct. 25, 2012

(30) Foreign Application Priority Data

Nov. 19, 2009 (JP) ..... 2009-264013

(51) Int. Cl.
*B65D 37/00* (2006.01)
*B65D 1/32* (2006.01)
*B65D 5/36* (2006.01)

(52) U.S. Cl.
CPC . *B65D 1/32* (2013.01); *B65D 37/00* (2013.01); *B65D 5/3628* (2013.01); *Y10S 215/90* (2013.01)
USPC ..... 222/209; 215/900

(58) Field of Classification Search
CPC ..... B56D 37/00; B65D 1/32; B65D 5/3628
USPC ..... 222/209, 213–215, 92, 107; 215/900; 220/666, 206, 720, 721
See application file for complete search history.

(56) References Cited

U.S. PATENT DOCUMENTS 5,337,924 A 8/1994 Dickie
5,897,033 A 4/1999 Okawa et al.
(Continued)

FOREIGN PATENT DOCUMENTS

CN 101175672 A 5/2008
JP 36 14985 6/1961
(Continued)

OTHER PUBLICATIONS

U.S. Appl. No. 13/515,084, filed Jun. 11, 2012, Inaba et al.
(Continued)

*Primary Examiner* — Lien Ngo
(74) *Attorney, Agent, or Firm* — Oblon, Spivak, McClelland, Maier & Neustadt, L.L.P.

(57) ABSTRACT

A container body (11) is provided with a squeeze operating portion (13*a*) between a shoulder portion (15) and a bottom portion (14), the squeeze operating portion including a squeeze face portion (16) opposed to a squeeze direction X, a pair of lateral support wall portions (17) arranged along the squeeze direction X at both side sections of the squeeze face portion (16), and inclined linking face portions (18) arranged as being inclined therebetween. When the squeeze face portion (16) is compressed to the squeeze direction x, the inclined linking face portions (18) expand distance between the pair of lateral support wall portions (17) at both sides as deforming along the squeeze face portion (16) from an inclined state against the squeeze face portion (16). The inclined linking face portions (18) are restricted so as not to be flipped in the squeeze direction (x) side after deformation completes as expansion force vanishes, so that constant quantity of content liquid is discharged.

20 Claims, 7 Drawing Sheets

(56) References Cited

U.S. PATENT DOCUMENTS

| | | | | |
|---|---|---|---|---|
| 7,699,183 | B2 * | 4/2010 | Matsuoka et al. | 215/383 |
| 8,118,183 | B2 * | 2/2012 | Iwahashi et al. | 215/12.2 |
| 8,127,970 | B2 * | 3/2012 | Cleary et al. | 222/215 |
| 2007/0045354 | A1 * | 3/2007 | Boyd et al. | 222/420 |
| 2007/0090083 | A1 * | 4/2007 | Trude | 215/384 |
| 2008/0232896 | A1 | 9/2008 | Gibson et al. | |
| 2008/0245762 | A1 | 10/2008 | Matsuoka et al. | |
| 2010/0237036 | A1 | 9/2010 | Trude | |

FOREIGN PATENT DOCUMENTS

| | | | | |
|---|---|---|---|---|
| JP | 180057 | | 12/1997 | |
| JP | 10-24950 | | 1/1998 | |
| JP | 10 24950 | | 1/1998 | |
| JP | 3061042 | | 6/1999 | |
| JP | 3061042 | | 9/1999 | |
| JP | 3603108 | | 12/2004 | |
| JP | 2006-16043 | * | 1/2006 | 222/215 |
| JP | 2006 219181 | | 8/2006 | |
| JP | 4074227 | | 4/2008 | |
| WO | WO 2007/004203 | A1 | 1/2007 | |
| WO | WO 2007/004203 | A8 | 1/2007 | |

OTHER PUBLICATIONS

The Extended European Search Report issued Mar. 8, 2013, in Application No. 10831510.2-1707 / 2502851 PCT/JP2010070172.

International Search Report Issued Feb. 15, 2011 in PCT/JP10/70172 Filed Nov. 12, 2010.

* cited by examiner

FIXED QUANTITY DISCHARGE SQUEEZE CONTAINER

CROSS REFERENCE TO RELATED APPLICATION

This application is a 371 of PCT/JP10/070,172, filed on Nov. 12, 2010, and claims priority to Japanese Patent Application No. 2009-264013, filed on Nov. 19, 2009.

TECHNICAL FIELD

The present invention relates to a fixed quantity discharge squeeze container, and in particular, relates to a fixed quantity discharge squeeze container to discharge content liquid from a discharge opening with squeeze deformation of a container body.

BACKGROUND ART

A squeeze container discharges specific quantity of content liquid from a discharge opening toward a discharge position owing to squeeze deformation of a container body by being squeezed (i.e., compressed) as a barrel portion of the plastic-made squeeze-deformable container body being held with a hand, for example. There has been developed a so-called fixed quantity discharge squeeze container devised to discharge constant quantity or approximately constant quantity of content liquid each time squeeze operation is repeated without variation of deformation quantity of the container body occurring when the barrel portion of the container body is squeezed (see Patent Literature 1 and Patent Literature 2, for example).

A fixed quantity discharge squeeze container of Patent Literature 1 is provided with an abutment member inside a container body to restrict depression quantity of the container body. Squeeze deformation quantity of the container body is restricted within a specific range by abutting a depressing operating portion to the abutment member when squeeze deformation of the container body is performed, so that constant quantity of content liquid is discharged each time. Meanwhile, in a fixed quantity discharge squeeze container of Patent Literature 2, a cylindrical cover body covers an outer peripheral wall of a container body and a bridge portion capable of being flipped toward the outer peripheral wall of the container body is formed at the cylindrical cover body. Constant quantity of content liquid is discharged each time as the outer peripheral wall of the container body deforms by specific quantity with squeeze deformation by flipping of the bridge portion.

CITATION LIST

Patent Literature

Patent Literature 1: JP 10-24950 A
Patent Literature 2: Japanese Patent No. 4074227

SUMMARY OF INVENTION

The present invention provides a fixed quantity discharge squeeze container which includes a plastic-made squeeze-deformable container body and which discharges specific quantity of content liquid from a discharge opening with squeeze deformation of the container body. The container body is provided with a squeeze operating portion between a shoulder portion and a bottom portion, the squeeze operating portion including a squeeze face portion arranged as being perpendicular to or approximately perpendicular to a squeeze direction, a pair of lateral support wall portions arranged along the squeeze direction at both side sections sandwiching the squeeze face portion, and inclined linking face portions which project the squeeze face portion to the direction opposite to the squeeze direction against the pair of lateral support wall portions as being arranged between the squeeze face portion and the lateral support wall portions respectively in an inclined manner. Each inclined linking face portion is arranged as being continued from the squeeze face portion and the lateral support wall portion via a joint edge line extending vertically. When a predetermined position of the squeeze face portion is compressed to the squeeze direction as being pressed with a finger, areas of the inclined linking face portions adjacent to the predetermined position expand the distance between the pair of lateral support wall portions of both sides at sections of the joint edge lines against the inclined linking face portions as deforming along the squeeze face portion from an inclined state against the squeeze face portion. After deformation completes as the expansion force vanishes, the inclined linking face portions are restricted so as not to be flipped in the squeeze direction side. Thus, variation of squeeze deformation quantity of the container body does not occur among repeated squeeze operations performed by pressing the predetermined position with the finger.

BRIEF DESCRIPTION OF DRAWINGS

FIG. 1(*b*) is a front view of the container body of the fixed quantity discharge squeeze container according to the first embodiment preferable for the present invention.

FIG. 1(*c*) is a sectional view along A-A of FIG. 1(*b*) of the container body of the fixed quantity discharge squeeze container according to the first embodiment preferable for the present invention.

FIG. 2(*b*) is an explanatory schematic sectional view illustrating a state of restricting squeeze deformation quantity of the container body at the time of squeeze operation of the fixed quantity discharge squeeze container according to the first embodiment preferable for the present invention.

FIG. 3(*b*) is a front view of the container body of the fixed quantity discharge squeeze container according to the second embodiment preferable for the present invention.

FIG. 3(*c*) is a sectional view along B-B of FIG. 3(*b*) of the container body of the fixed quantity discharge squeeze container according to the second embodiment preferable for the present invention.

FIG. 4(*b*) is an explanatory schematic sectional view of illustrating a state of restricting squeeze deformation quantity of the container body at the time of squeeze operation of the fixed quantity discharge squeeze container according to the second embodiment preferable for the present invention.

FIG. 5(*b*) is a front view of the container body of the fixed quantity discharge squeeze container according to the third embodiment preferable for the present invention.

FIG. 5(*c*) is a sectional view along C-C of FIG. 5(*b*) of the container body of the fixed quantity discharge squeeze container according to the third embodiment preferable for the present invention.

FIG. 6(*b*) is a front view of the container body of the fixed quantity discharge squeeze container according to the fourth embodiment preferable for the present invention.

FIG. 6(*c*) is a sectional view along D-D of FIG. 6(*b*) of the container body of the fixed quantity discharge squeeze container according to the fourth embodiment preferable for the present invention.

FIG. 7(*b*) is a front view of the container body of the fixed quantity discharge squeeze container according to the fifth embodiment preferable for the present invention.

FIG. 7(*c*) is a sectional view along E-E of FIG. 7(*b*) of the container body of the fixed quantity discharge squeeze container according to the fifth embodiment preferable for the present invention.

DESCRIPTION OF EMBODIMENTS

Figure 1A:
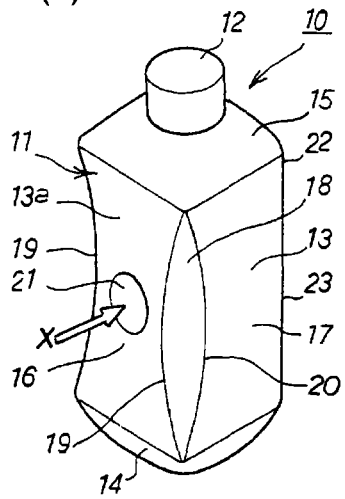
FIG. 1(*a*) is a perspective view of a container body of a fixed quantity discharge squeeze container according to a first embodiment preferable for the present invention.

The conventional fixed quantity discharge squeeze container described above is required to attach the abutment member to the inside of the container body or to attach the cylindrical cover member at which a bridge portion is formed covering the outer peripheral wall of the container body. Therefore, the structure becomes complicated and the cost of manufacturing increases. Accordingly, development of new technology has been desired which enables to discharge constant quantity of content liquid each time by restricting the squeeze deformation quantity of the container body to prevent occurrence of variation among repeated squeeze operations owing to devising of the shape of the container body without utilizing the abutment member or the cylindrical cover member.

The present invention relates to a fixed quantity discharge squeeze container which enables to discharge constant quantity of content liquid each time by restricting the squeeze deformation quantity of the container body to prevent occurrence of variation among repeated squeeze operations owing to devising of the shape of the container body.

The present invention provides a fixed quantity discharge squeeze container which includes a plastic-made squeeze-deformable container body and which discharges specific quantity of content liquid from a discharge opening with squeeze deformation of the container body. The container body is provided with a squeeze operating portion between a shoulder portion and a bottom portion, the squeeze operating portion including a squeeze face portion arranged as being perpendicular to or approximately perpendicular to a squeeze direction, a pair of lateral support wall portions arranged along the squeeze direction at both side sections sandwiching the squeeze face portion, and inclined linking face portions which project the squeeze face portion to the direction opposite to the squeeze direction against the pair of lateral support wall portions as being arranged between the squeeze face portion and the lateral support wall portions respectively in an inclined manner. Each inclined linking face portion is arranged as being continued from the squeeze face portion and the lateral support wall portion via a joint edge line extending vertically. When a predetermined position of the squeeze face portion is compressed to the squeeze direction as being pressed with a finger, areas of the inclined linking face portions adjacent to the predetermined position expand the distance between the pair of lateral side support wall portions of both sides at the joint edge lines against the inclined linking face portions as deforming along the squeeze face portion from an inclined state against the squeeze face portion. After deformation completes as the expansion force vanishes, the inclined linking face portions are restricted so as not to be flipped in the squeeze direction side. Thus, variation of squeeze deformation quantity of the container body does not occur among repeated squeeze operations performed by pressing the predetermined position with the finger.

Figure 1B:
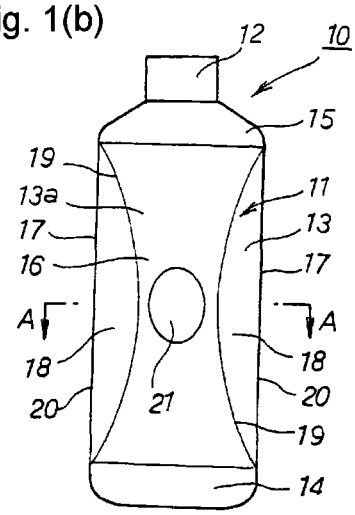
Figure 1C:
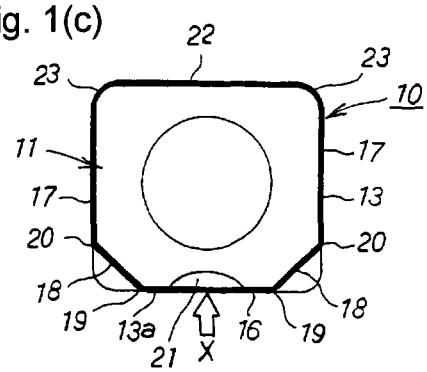

A fixed quantity discharge squeeze container 10 according to a first embodiment preferable for the present invention as illustrated in FIGS. 1(*a*) to 1(*c*) includes a plastic-made squeeze-deformable container body 11 and a cap member (not illustrated) attached to a mouth neck portion 12 of the container body 11 in a detachably attachable manner. The squeeze container 10 can accommodate liquid cleaner for clothing, fabric softener liquid, bleacher, dish liquid, or bath additive for example as a content liquid. The squeeze container 10 can discharge specific quantity of content liquid from a discharge opening arranged at the cap member, for example, toward the discharge position by deforming the container body 11 as squeezing (compressing) a barrel portion 13 of the container body 11 which is held in a tilted or inverted state. The squeeze container 10 has a function to discharge constant quantity of the content liquid each time by restricting the squeeze deformation quantity of the container body 11 to prevent occurrence of variation among repeated squeeze operations performed by compressing a predetermined position of the barrel portion 13 with a finger, for example, owing to devising of only the shape of the container body 11.

That is, the squeeze container 10 is a squeeze container which includes the plastic-made squeeze-deformable container body 11 and which discharges specific quantity of content liquid from the discharge opening with squeeze deformation of the container body 11. As illustrated in FIGS. 1(*a*) and 1(*b*), the container body 11 has a squeeze operating portion 13*a* having an approximately rectangular projected shape in view from the front face direction being a squeeze direction X at the barrel portion 13 between a bottom portion 14 of the lower section and a shoulder portion 15 of the upper section. The squeeze operating portion 13*a* of the barrel portion 13 includes a squeeze face portion 16 arranged as being perpendicular to or approximately perpendicular to the squeeze direction X, a pair of lateral support wall portions 17 which are arranged along the squeeze direction X at both side sections sandwiching the squeeze face portion 16, and a pair of inclined linking face portions 18 which projects the squeeze face portion 16 to the direction opposite to the squeeze direction X against the pair of lateral support wall portions 17 as being arranged between the squeeze face portion 16 and the lateral support wall portions 17 respectively in an inclined manner.

The inclined linking face portions 18 are respectively arranged as being continued from the squeeze face portion 16 and the lateral support wall portion 17 via two joint edge lines 19, 20 extending vertically. When a predetermined position of the squeeze face portion 16 is compressed to the squeeze direction X as being pressed with a finger (see FIG. 2(*a*)), areas of the inclined linking face portions 18 adjacent to the predetermined position expand the distance between the pair of lateral support wall portions 17 of both sides at the joint edge lines 20 against the inclined linking face portions 18 as deforming along the squeeze face portion 16 from an inclined state against the squeeze face portion 16, and deform. After deformation of the inclined linking face portions 18 completes as the expansion force vanishes (see FIG. 2(*b*)), the inclined linking face portions 18 being adjacent to the predetermined position to be pressed with a finger are restricted so as not to be flipped in the squeeze direction side. Thus, variation of a squeeze deformation quantity of the container body 11 does not occur among repeated squeeze operations performed by pressing the predetermined position of the squeeze face portion 16 with the finger. Accordingly, constant quantity of content liquid can be discharged each time.

Further in the first embodiment, the inclined linking face portions 18 have a ship-like front shape, while the joint edge lines 19, 20 at both sides are curved so that the width of the upper and lower end sections being adjacent to the shoulder portion 15 and the bottom portion 14 is narrowed and that the width is gradually extended toward the center section (see FIG. 1(*a*)).

Further in the first embodiment, a squeeze position guide portion 21 is formed as a concave portion caved in a round shape which guides the predetermined position to perform squeeze operation for constant quantity discharge with the finger. The squeeze position guide portion 21 is arranged at the center section of the squeeze face portion 16 and preferably at the position where the width of the squeeze face portion 16 is most narrowed (i.e., the width of the inclined linking face portion 18 is most extended).

In the first embodiment, the container body 11 is made of various types of synthetic resin known as being suitable for forming squeeze-deformable plastic container such as polyethylene terephthalate, polypropylene, high density polyethylene, and chloroethene, for example. The container body 11 is formed by blow molding, for example, into a hollow bottle shape including the bottom portion 14, the barrel portion 13, the shoulder portion 15, and the mouth neck portion 12. The container body 11 is formed such that the shoulder portion 15 and the mouth neck portion 12 at the upper end section and the bottom portion 14 at the lower end section are thicker than the barrel portion 13 and that the shoulder portion 15 and the bottom portion 14 are formed as being approximately quadrate in plane view. Accordingly, the approximately quadrate sectional shape at the top end section and the bottom end section is strongly and stably maintained.

In the first embodiment, the entire barrel portion 13 sandwiched between the shoulder portion 15 and the bottom portion 14 is to be the squeeze operating portion 13*a* having an approximately rectangular projected shape which is vertically long in view from the front face direction being the squeeze direction X (see FIG. 1(*b*)). Since the barrel portion 13 is formed thinner than the shoulder portion 15 and the bottom portion 14, the barrel portion 13 is structured to have flexibility as being easily squeeze-deformable with a force of a hand or a finger holding the barrel portion 13.

In the first embodiment, the barrel portion 13 is structured with the squeeze face portion 16, the pair of inclined linking face portions 18 arranged at both sides sandwiching the squeeze face portion 16, the pair of lateral support wall portions 17 arranged to be approximately perpendicular to the squeeze face portion 16 as being continued from the inclined linking face portions 18, and a back wall portion 22 arranged as facing to the squeeze face portion 16 to be approximately parallel thereto as integrally connecting the end sections of the pair of lateral support wall portions 17 at the opposite side to the inclined linking face portions 18.

The joint edge lines 19 between the inclined linking face portions 18 and the squeeze face portion 16 and the joint edge lines 20 between the inclined linking face portions 18 and the lateral support wall portions 17 are extended vertically between the shoulder portion 15 and the bottom portion 14 respectively in a curved state so that the inclined linking face portions 18 have a ship-like front shape as mentioned above. Corner portion joint edge lines 23 between the pair of the lateral support wall portions 17 and the back wall portion 22 are edge lines having approximately an arc sectional shape of quarter round extended vertically between the shoulder portion 15 and the bottom portion 14 respectively with larger curvature than that of the joint edge lines 19, 20 between the inclined linking face portions 18 and the squeeze face portion 16 and the lateral support wall portions 17.

With the above structure, at the back face side, the cross-sectional shape of the barrel portion 13 except for the sections of the upper end and the lower end is shaped as the pair of the lateral support wall portions 17 being jointed with the back wall portion 22 via the corner portion joint edge lines 23 as being approximately perpendicular as illustrated in FIG. 1(*c*). On the other hand, at the front face side, the squeeze face portion 16 is shaped to be an isosceles trapezoid protruded from the joint edge lines 20 in the direction opposite to the squeeze direction X against the lateral support wall portions 17 via the pair of the inclined linking face portions 18. Further, the cross-sectional shape of the barrel portion 13 except for the sections of the upper end and the lower end is approximately a hexagonal shape as a whole (see FIG. 1(*c*)). The cross-sectional shape of the barrel portion 13 at the upper end and the lower end is approximately a quadrate shape as the width of the inclined linking face portions 18 disappears. Thus, the barrel portion 13 is integrally jointed to the shoulder portion 15 and the bottom portion 14.

Figure 2A:
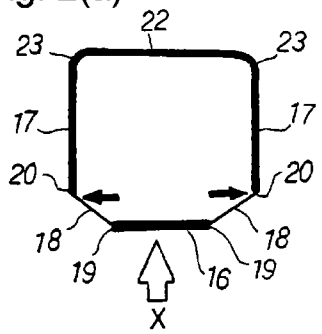
FIG. 2(*a*) is an explanatory schematic sectional view illustrating a state of restricting squeeze deformation quantity of the container body at the time of squeeze operation of the fixed quantity discharge squeeze container according to the first embodiment preferable for the present invention.
Figure 2B:
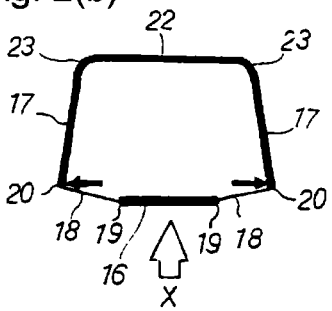

According to the fixed quantity discharge squeeze container 10 of the first embodiment having the above structure, compressing force is to be applied to the squeeze face portion 16 as pressing the concave squeeze position guide portion 21 with a thumb, for example, in a state that the discharge opening is oriented toward the discharge position after the container 10 is tilted or inverted by holding the barrel portion 13 of the container body 11 in order to discharge constant quantity of content liquid with squeeze deformation of the container body 11. Accordingly, as illustrated in FIGS. 2(*a*) and 2(*b*), sections of the squeeze face portion 16 adjacent to the squeeze position guide portion 21 are pressed into the squeeze direction X as sections of the inclined linking face portions 18 adjacent to the squeeze position guide portion 21 deform along the squeeze face portion 16 from an inclined state against the squeeze face portion 16 and expand the distance between the pair of lateral support wall portions 17 of both sides at the sections of the joint edge lines 19 with the inclined linking face portions 18 with compressing force being supported by the pair of lateral support wall portions 17. When the inclined linking face portions 18 adjacent to the squeeze position guide portion 21 are deformed along the squeeze face portion 16 from a inclined state, volume of the container body 11 decreases while the section having sectional isosceles trapezoid shape formed with the pair of inclined linking face portions 18 and the squeeze face portion 16 is flattened out to be flat. Accordingly, discharge of the content liquid can be performed owing to the volume decrease. Here, in FIGS. 1(*a*) to 1(*c*) and FIGS. 2(*a*) and 2(*b*), the squeeze position guide portion is formed into an approximately round concave shape. However, it is also possible to be formed into a convex or elliptically shaped or the like.

In the first embodiment, when the inclined linking face portions 18 deform by a position being approximately parallel to the squeeze face portion 16, the inclined linking face portions 18 cannot expand the distance between the pair of lateral support wall portions 17 any more as the section having sectional isosceles trapezoid shape formed with the pair of inclined linking face portions 18 and the squeeze face portion 16 is fully stretched to be flat, as illustrated in FIG. 2(*b*). Even if the squeeze face portion 16 is to be further pressed into the squeeze direction X from the above state to flip the inclined linking face portions 18 to the squeeze direction X side, sections of the inclined linking face portions 18 being apart from the squeeze position guide portion 21 to which compressing force is applied are not deformed to the position being approximately parallel to the squeeze face portion 16. Therefore, sections of the inclined linking face portions 18 adjacent to the squeeze position guide portion 21 pressed with the finger is restricted from being flipped in the squeeze direction side owing to action of the squeeze face portion 16 and the pair of the inclined linking face portions 18 of which sections are apart from the squeeze position guide portion 21. Accordingly, when compressing force is applied to the squeeze position guide portion 21 with a thumb pressing thereto, for example, squeeze deformation of the container body 11 is performed with constant deformation quantity at any time. That is, constant quantity discharge can be easily performed with predetermined quantity of content liquid since variation of squeeze deformation quantity of the container body 11 does not occur among repeated squeeze operations.

According to the fixed quantity discharge squeeze container 10 of the first embodiment, constant quantity of content liquid can be discharged by restricting the squeeze deformation quantity of the container body 11 so that variation does not occur among repeated squeeze operations owing to devising of only the shape of the container body 11.

Figure 3A:
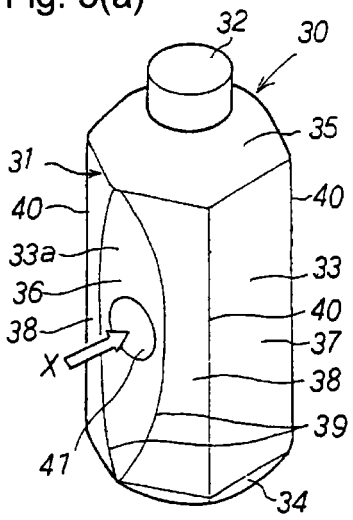
FIG. 3(*a*) is a perspective view of a container body of a fixed quantity discharge squeeze container according to a second embodiment preferable for the present invention.
Figure 3B:
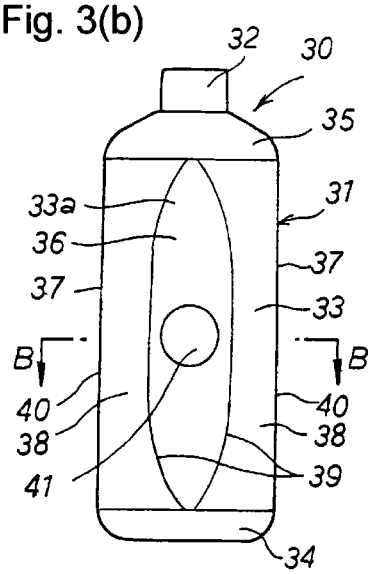
Figure 3C:
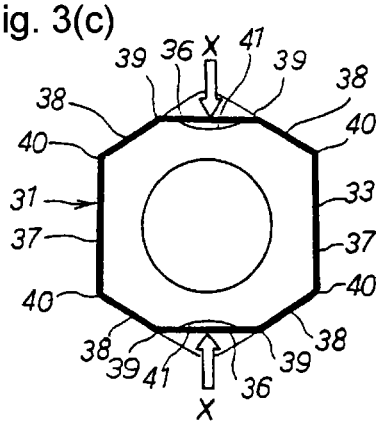

FIGS. 3(*a*) to 3(*c*) illustrate a container body 31 of a fixed quantity discharge squeeze container 30 according to a second embodiment preferable for the present invention. According to the second embodiment, the container body 31 is made of synthetic resin and is formed into a hollow bottle shape including a barrel portion 33, a bottom portion 34, a shoulder portion 35, and a mouth neck portion 32 as being similar to the container body 11 of the fixed quantity discharge squeeze container 10 of the above first embodiment. In the second embodiment, the thin barrel portion 33 sandwiched between the thick shoulder portion 35 and bottom portion 34 as a whole is to be a squeeze operating portion 33*a* having an approximately rectangular projected shape which is vertically long in view from the front face direction being a squeeze direction X (see FIG. 3(*b*)).

In the second embodiment, a pair of segments structuring the barrel portion 33, each including a squeeze face portion 36 arranged as being perpendicular to or approximately perpendicular to the squeeze direction X and inclined linking face portions 38 arranged at both sides thereof, is arranged in an opposed manner at front face portions (i.e., a front face portion and a back face portion) of both front and back sides sandwiching a pair of lateral support wall portions 37.

That is, in the second embodiment, the thick shoulder portion 35 and bottom portion 34 are respectively formed to have an approximately hexagonal plane shape in view from the upper side and lower side, so that the approximately hexagonal sectional shape at the upper end section and lower end section of the barrel portion 33 is strongly and stably maintained. The squeeze face portions 36 at front face portions of both front and back sides of the thin barrel portions 33 have a ship-like front shape and joint edge lines 39 respectively between the squeeze face portion 36 and the inclined linking face portions 38 at both sides are extended vertically between the shoulder portion 35 and the bottom portion 34 in a curved state. Further, joint edge lines 40 respectively between the pair of lateral support wall portions 37 and the inclined linking face portions 38 at both sides of the squeeze face portion 36 are extended vertically in a linear state between the shoulder portion 35 and the bottom portion 34.

With the above structure, as illustrated in FIG. 3(*c*), the cross-sectional shape of the barrel portion 33 except for the sections of the upper end and the lower end is approximately an octagonal shape as a whole, as the squeeze face portions 36 at front face portions of both front and back sides are shaped respectively to be an isosceles trapezoid protruded from the joint edge lines 40 at both sides in the direction opposite to the squeeze direction X against the lateral support wall portions 37 via the pair of the inclined linking face portions 38. The cross-sectional shape of the barrel portion 33 at the upper end and the lower end is approximately a hexagonal shape as a whole as the width of the squeeze face portions 36 disappears. Thus, the barrel portion 33 is integrally jointed to the shoulder portion 35 and the bottom portion 34.

Figure 4A:
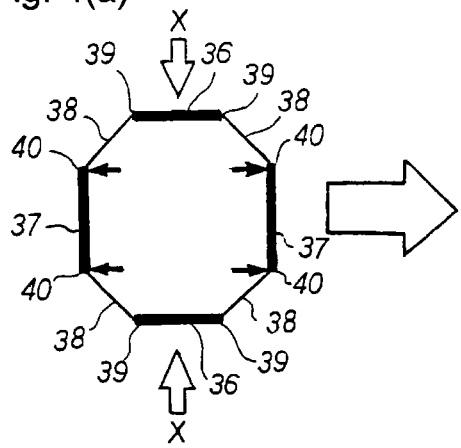
FIG. 4(*a*) is an explanatory schematic sectional view illustrating a state of restricting squeeze deformation quantity of the container body at the time of squeeze operation of the fixed quantity discharge squeeze container according to the second embodiment preferable for the present invention.
Figure 4B:
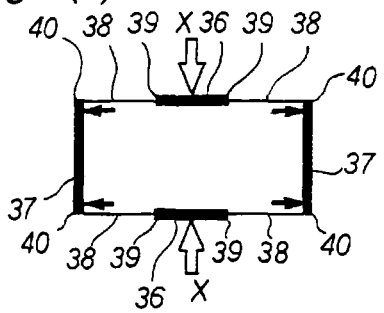

According to the fixed quantity discharge squeeze container 30 of the second embodiment having the above structure, compressing force is to be applied to the squeeze face portion 36 of both front and back sides by sandwiching from both sides (see FIG. 4(*a*)) as pressing concave squeeze position guide portion 41 of one squeeze face portion 36 with a thumb and the concave squeeze position guide portion 41 of the other squeeze face portion 36 with an index finger, for example, in a state that a discharge opening is oriented toward a discharge position by holding the barrel portion 33 of the container body 31. Accordingly, the inclined linking face portions 38 expand the distance of the pair of lateral support wall portions 37 at both sides at the sections of the joint edge lines 40 between the inclined linking face portions 38 as sections of the inclined linking face portions 38 adjacent to the squeeze position guide portion 41 deform along the squeeze face portion 36 from a inclined state against the squeeze face portion 36. Accordingly, discharge of the content liquid can be performed with volume decrease of the container body 31.

As illustrated in FIG. 4(*b*), when the respective pairs of inclined linking face portions 38 deform by a position being approximately parallel to the squeeze face portions 36 of the both front and back sides from a inclined state against the squeeze face portion 36, the inclined linking face portions 38 cannot expand the distance between the pair of lateral support wall portions 37 any more as the section having sectional isosceles trapezoid shape formed with the pairs of inclined linking face portions 38 and the squeeze face portions 36 are fully stretched to be flat. Even if the squeeze face portions 36 are to be further pressed into the squeeze direction X from the above state to flip the inclined linking face portions 38 to the squeeze direction X side, sections of the inclined linking face portions 38 adjacent to the squeeze position guide portion 41 are restricted from being flipped in the squeeze direction side owing to action of the squeeze face portion 36 and the pair of the inclined linking face portions 38 of which sections are apart from the squeeze position guide portion 41. Accordingly, when compressing force is applied to the squeeze position guide portions 41 as pressing with a thumb and an index finger, for example, squeeze deformation of the container body 31 is performed with constant deformation quantity at any time. That is, the fixed quantity discharge squeeze container 30 of the second embodiment can obtain similar operational effects to the fixed quantity discharge squeeze container 10 of the first embodiment.

Figure 5A:
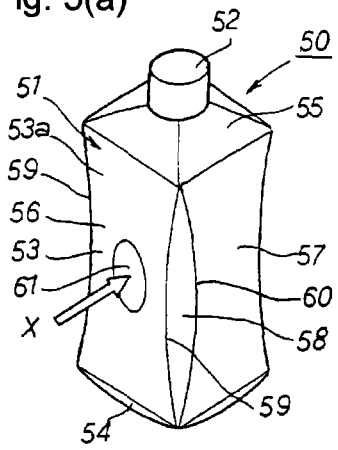
FIG. 5(*a*) is a perspective view of a container body of a fixed quantity discharge squeeze container according to a third embodiment preferable for the present invention.
Figure 5B:
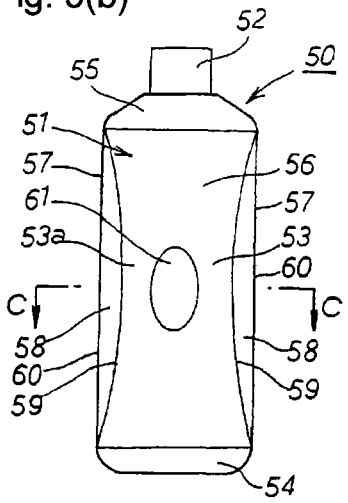
Figure 5C:
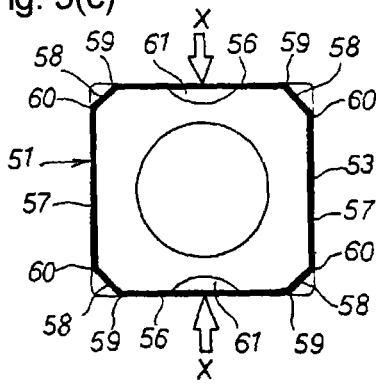

FIGS. 5(*a*) to 5(*c*) illustrate a container body 51 of a fixed quantity discharge squeeze container 50 according to a third embodiment preferable for the present invention. According to the third embodiment, the container body 51 is made of synthetic resin and is formed into a hollow bottle shape including a barrel portion 53, a bottom portion 54, a shoulder portion 55, and a mouth neck portion 52 as being similar to the container body 11 of the fixed quantity discharge squeeze container 10 of the above first embodiment. In the third embodiment, the thin barrel portion 53 sandwiched between the thick shoulder portion 55 and bottom portion 54 as a whole is to be a squeeze operating portion 53*a* having an approximately rectangular projected shape which is vertically long in view from the front face direction being a squeeze direction X (see FIG. 5(*b*)).

In the third embodiment, a pair of segments structuring the barrel portion 53, each including a squeeze face portion 56 arranged as being perpendicular to or approximately perpendicular to the squeeze direction X and inclined linking face portions 58 arranged at both sides thereof, is arranged in an opposed manner at front face portions (i.e., a front face portion and a back face portion) of both front and back sides as sandwiching a pair of lateral support wall portions 57.

That is, in the third embodiment, the thick shoulder portion 55 and bottom portion 54 are respectively formed to have an approximately square plane shape in view from the upper side and lower side, so that the approximately square sectional shape at the upper end section and lower end section of the barrel portion 53 is strongly and stably maintained. The inclined linking face portions 58 at both sides of the squeeze face portions 56 at front face portions of both front and back sides of the of the thin barrel portions 53 have a ship-like front shape and joint edge lines 59, 60 respectively between the inclined linking face portions 58 and the squeeze face portions 56 and lateral support wall portions 57 are extended vertically in a curved state between the shoulder portion 55 and the bottom portion 54.

With the above structure, as illustrated in FIG. 5(*c*), the cross-sectional shape of the barrel portion 53 except for the sections of the upper end and the lower end is approximately an octagonal shape as a whole, as the squeeze face portions 56 at front face portions of both front and back sides are shaped respectively to be an isosceles trapezoid shape protruded from the joint edge lines 59 at both sides in the direction opposite to the squeeze direction X against the lateral support wall portions 57 via the pair of the inclined linking face portions 58. The cross-sectional shape of the barrel portion 53 at the upper end and the lower end is approximately a square shape as a whole as the width of the inclined linking face portions 58 disappears. Thus, the barrel portion 53 is integrally jointed to the shoulder portion 55 and the bottom portion 54.

According to the fixed quantity discharge squeeze container 50 of the third embodiment having the above structure, compressing force is to be applied to the squeeze face portion 56 of both front and back sides by sandwiching from both sides as pressing concave squeeze position guide portions 61 with a thumb and an index finger, for example. Then, squeeze deformation of the container body 51 is performed with constant deformation quantity at any time. Thus, the fixed quantity discharge squeeze container 50 of the third embodiment can obtain similar operational effects to the fixed quantity discharge squeeze container 10 of the first embodiment.

Figure 6A:
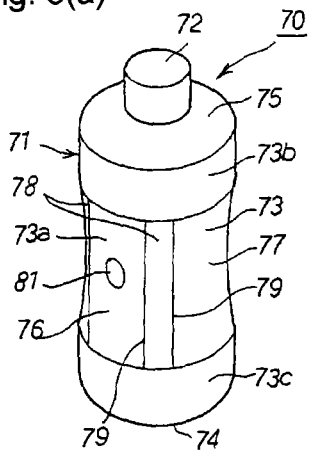
FIG. 6(*a*) is a perspective view of a container body of a fixed quantity discharge squeeze container according to a fourth embodiment preferable for the present invention.
Figure 6B:
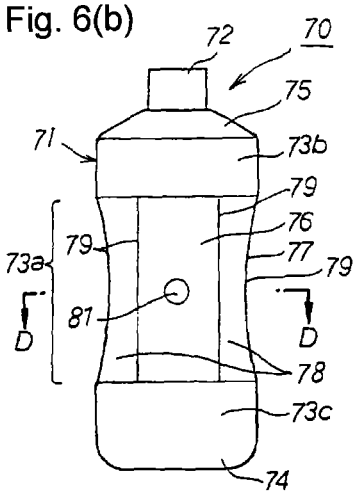
Figure 6C:
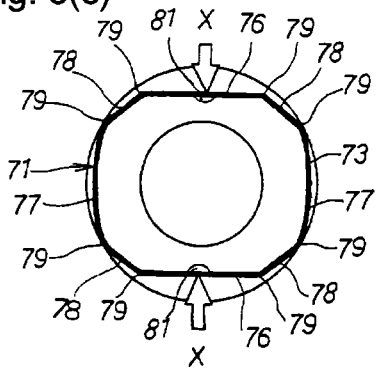

FIGS. 6(*a*) to 6(*c*) illustrate a container body 71 of a fixed quantity discharge squeeze container 70 according to a fourth embodiment preferable for the present invention. According to the fourth embodiment, the container body 71 is made of synthetic resin and is formed into a hollow bottle shape including a barrel portion 73, a bottom portion 74, a shoulder portion 75, and a mouth neck portion 72 as being similar to the container body 11 of the fixed quantity discharge squeeze container 10 of the above first embodiment. In the fourth embodiment, a section between an upper cylindrical portion 73*b* and a lower cylindrical portion 73*c* within the thin barrel portion 73 sandwiched between the thick shoulder portion 75 and bottom portion 74 is to be a squeeze operating portion 73*a* (see FIG. 6(*b*)).

In the fourth embodiment, a pair of segments structuring the squeeze operating portion 73*a* of the barrel portion 73, each including a squeeze face portion 76 arranged as being perpendicular to or approximately perpendicular to the squeeze direction X and inclined linking face portions 78 arranged at both sides thereof, is arranged in an opposed manner at front face portions (i.e., a front face portion and a back face portion) of both front and back sides as sandwiching a pair of lateral support wall portions 77.

That is, in the fourth embodiment, the thick shoulder portion 75 and bottom portion 74 are respectively formed to have a circulate plane shape in view from the upper side and lower side, so that the circulate sectional shape at the upper cylindrical portion 73*b* and lower cylindrical portion 73*c* of the barrel portion 73 is strongly and stably maintained. The sectional shape of the squeeze operating portion 73*a* which is between the upper cylindrical portion 73*b* and the lower cylindrical portion 73*c* of the thin barrel portion 73 is to be an approximately octagonal shape as a whole as the squeeze face portion 76 of front face portions in both front and back side is shaped to be an isosceles trapezoid shape protruded in the direction opposite to the squeeze direction X against the lateral support wall portions 77 via the linear shaped pairs of joint edge lines 79 and inclined linking face portions 78 at both sides (see FIG. 6(*c*)).

According to the fixed quantity discharge squeeze container 70 of the fourth embodiment having the above structure, compressing force is to be applied to the squeeze face portion 76 of both front and back sides by sandwiching from both sides as pressing a squeeze position guide portions 81 with a thumb and an index finger, for example. Then, squeeze deformation of the container body 71 is performed with constant deformation quantity at any time. Thus, the fixed quantity discharge squeeze container 70 of the fourth embodiment can obtain similar operational effects to the fixed quantity discharge squeeze container 10 of the first embodiment.

Figure 7A:
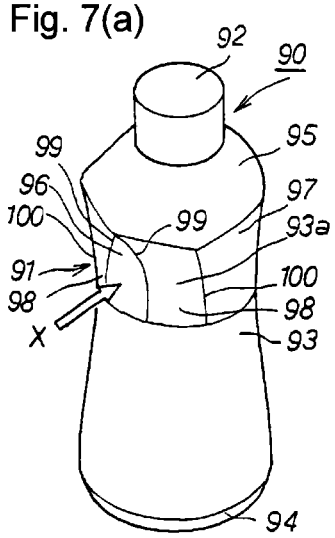
FIG. 7(*a*) is a perspective view of a container body of a fixed quantity discharge squeeze container according to a fifth embodiment preferable for the present invention.
Figure 7B:
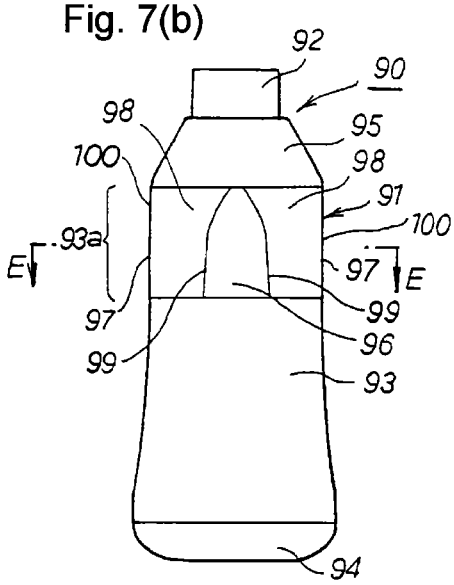
Figure 7C:
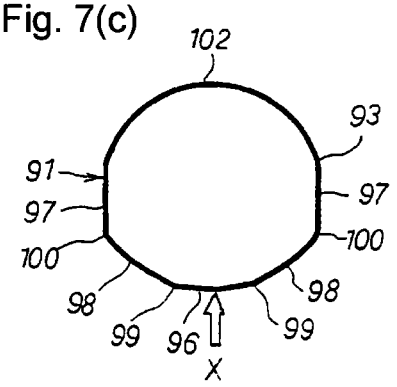

FIGS. 7(*a*) to 7(*c*) illustrate a container body 91 of a fixed quantity discharge squeeze container 90 according to a fifth embodiment preferable for the present invention. According to the fifth embodiment, the container body 91 is made of synthetic resin and is formed into a hollow bottle shape including a barrel portion 93, a bottom portion 94, a shoulder portion 95, and a mouth neck portion 92 as similar to the container body 11 of the fixed quantity discharge squeeze container 10 of the above first embodiment. In the fifth embodiment, approximately an upper one third part of the thin barrel portion 93 sandwiched between the thick shoulder portion 95 and bottom portion 94 is to be a squeeze operating portion 93*a* (see FIG. 7(*b*)).

In the fifth embodiment, the squeeze operating portion 93*a* of the barrel portion 93 is structured with a squeeze face portion 96, a pair of inclined linking face portions 98 arranged at both sides sandwiching the squeeze face portion 96, a pair of lateral support wall portions 97 arranged as being continued to the inclined linking face portions 98 and on a face approximately being perpendicular to the squeeze face portion 96, and an arc-shaped back wall portion 102 which is arranged opposing to the squeeze face portion 96 integrally connecting the end sections of the pair of lateral support wall portions 97 at the opposite side to the inclined linking face portions 98.

That is, in the fifth embodiment, the thick shoulder portion 95 is formed to have an approximately half oval shape at the back face side and an approximately isosceles mountain shape at the front face side in view from the upper side and the bottom portion 94 is formed to have a circular plane shape in view from the lower side. The thin barrel portion 93 is formed to have approximately two thirds of the lower section being an approximately cylindrical shape. Further, at the back face side, the squeeze operating portion 93*a* being approximately the upper one third section of the barrel portion 93 has a cross-sectional shape as an approximately half oval shape formed as the pair of lateral support wall portion 97 and the back wall portion 102 continued, as illustrated in FIG. 7(*c*). On the other hand, at the front face side, the squeeze face portion 96 is shaped to be an isosceles trapezoid protruded in the direction opposite to the squeeze direction X against the lateral support wall portions 97 via the joint edge lines 99, 100 and the pair of the inclined linking face portions 98 (see FIG. 7(*c*)). Further, the joint edge lines 99 between the squeeze face portion 96 and both sides of the inclined linking face portion 98 are arranged as extending vertically in a curved state and the upper end of the barrel portion 93 is integrally jointed with the shoulder portion 95 as the width of the squeeze face portion 96 disappears.

According to the fixed quantity discharge squeeze container 90 of the fifth embodiment having the above structure, compressing force is to be applied to the squeeze face portion 96 by pressing with a thumb, for example. Then, squeeze deformation of the container body 91 is performed with constant deformation quantity at any time. Thus, the fixed quantity discharge squeeze container 90 of the fifth embodiment can obtain similar operational effects to the fixed quantity discharge squeeze container 10 of the first embodiment.

Here, not limited to the above embodiments, the present invention may be modified variously. For example, a squeeze position guide portion is not necessarily arranged at a squeeze surface portion. Here, a position to perform squeeze operation with a finger may be indicated by modifying the surface of the container to be rough as partially modifying roughness of a mold surface or by printing, and the like. Further, the position to arrange the squeeze position guide portion and the position to perform squeeze operation are not necessarily required to be the center section of the squeeze face portion. Instead, squeeze operation may be performed with compressing at an arbitrary position of the squeeze face portion to compress. Furthermore, the discharge quantity of the content liquid to be constant quantity discharged with the squeeze operation may be appropriately adjusted by selecting a squeezing position.

INDUSTRIAL APPLICABILITY

According to the fixed quantity discharge squeeze container of the present invention, constant quantity of content liquid can be discharged by restricting the squeeze deformation quantity of the container body to prevent occurrence of variation among repeated squeeze operations owing to devising of only the shape of the container body.

The invention claimed is:

1. A fixed quantity discharge squeeze container, comprising:

a plastic-made squeeze-deformable container body to discharge a specific quantity of content liquid from a discharge opening with squeeze deformation of the container body, wherein the container body comprises a squeeze operating portion between a shoulder portion and a bottom portion in a vertical direction, the squeeze operating portion comprising a squeeze face portion arranged as being perpendicular to or approximately perpendicular to a squeeze direction, a pair of lateral support wall portions arranged along the squeeze direction at both side sections sandwiching the squeeze face portion, and inclined linking face portions which project the squeeze face portion to the direction opposite to the squeeze direction against the pair of lateral support wall portions as being arranged between the squeeze face portion and the lateral support wall portions;

the inclined linking face portions are arranged as being continued from the squeeze face portion and the lateral support wall portion via joint edge lines extending in the vertical direction;

the joint edge lines form vertexes with lower and upper edge lines provided between the squeeze operating portion and respective ones of the bottom portion and the upper portion, the lower and upper edge lines extend in a horizontal direction, and the joint edge lines extend in the vertical direction from the lower edge line to the upper edge line; and areas of the inclined linking face portions adjacent to a predetermined position expand a distance between the pair of lateral support wall portions of both sides at sections of the joint edge lines against the inclined linking face portions as deforming along the squeeze face portion from an inclined state against the squeeze face portion when the predetermined position of the squeeze face portion is compressed to the squeeze direction with application of an expansion force, such that the inclined linking face portions deform by bending at the joint edge lines when the expansion force is applied, while the inclined linking face portions are restricted so as not to be flipped in the squeeze direction side after deformation completes as the expansion force is removed, so as to prevent occurrence of variation in squeeze deformation quantity of the container body among repeated squeeze operations performed by applying the expansion force to the predetermined position.

2. The fixed quantity discharge squeeze container according to claim 1, wherein the squeeze face portion has a ship-like front shape.

3. The fixed quantity discharge squeeze container according to claim 1, wherein the inclined linking face portions form a ship-like front shape.

4. The fixed quantity discharge squeeze container according to claim 1, wherein the squeeze face portion is formed with a squeeze position guide portion which guides the predetermined position to perform squeeze operation for constant quantity discharge.

5. The fixed quantity discharge squeeze container according to claim 2, wherein the squeeze face portion is formed with a squeeze position guide portion which guides the predetermined position to perform squeeze operation for constant quantity discharge.

6. The fixed quantity discharge squeeze container according to claim 3, wherein the squeeze face portion is formed with a squeeze position guide portion which guides the predetermined position to perform squeeze operation for constant quantity discharge.

7. The fixed quantity discharge squeeze container according to claim 3, wherein widths of the inclined linking face portions are greater at center sections thereof than at lower and upper end portions thereof in the vertical direction.

8. The fixed quantity discharge squeeze container according to claim 1, wherein a pair of segments, each comprising a squeeze face portion arranged as being perpendicular to or approximately perpendicular to the squeeze direction and inclined linking face portions arranged at both sides thereof, is arranged in an opposed manner at front face portions of both front and back sides as sandwiching the pair of lateral support wall portions.

9. The fixed quantity discharge squeeze container according to claim 2, wherein a pair of segments, each comprising a squeeze face portion arranged as being perpendicular to or approximately perpendicular to the squeeze direction and inclined linking face portions arranged at both sides thereof, is arranged in an opposed manner at front face portions of both front and back sides as sandwiching the pair of lateral support wall portions.

10. The fixed quantity discharge squeeze container according to claim 3, wherein a pair of segments, each comprising a squeeze face portion arranged as being perpendicular to or approximately perpendicular to the squeeze direction and inclined linking face portions arranged at both sides thereof, is arranged in an opposed manner at front face portions of both front and back sides as sandwiching the pair of lateral support wall portions.

11. The fixed quantity discharge squeeze container according to claim 4, wherein a pair of segments, each comprising a squeeze face portion arranged as being perpendicular to or approximately perpendicular to the squeeze direction and inclined linking face portions arranged at both sides thereof, is arranged in an opposed manner at front face portions of both front and back sides as sandwiching the pair of lateral support wall portions.

12. The fixed quantity discharge squeeze container according to claim 7, wherein a pair of segments, each comprising a squeeze face portion arranged as being perpendicular to or approximately perpendicular to the squeeze direction and inclined linking face portions arranged at both sides thereof, is arranged in an opposed manner at front face portions of both front and back sides as sandwiching the pair of lateral support wall portions.

13. The fixed quantity discharge squeeze container according to claim 1, wherein corner portion joint edge lines between the lateral support wall portions and a back wall portion arranged as facing to the squeeze face portion are edge lines having approximately an arc sectional shape of quarter round with larger curvature than that of the joint edge lines between the inclined linking face portions and the squeeze face portion or the lateral support wall portions.

14. The fixed quantity discharge squeeze container according to claim 2, wherein corner portion joint edge lines between the lateral support wall portions and a back wall portion arranged as facing to the squeeze face portion are edge lines having approximately an arc sectional shape of quarter round with larger curvature than that of the joint edge lines between the inclined linking face portions and the squeeze face portion or the lateral support wall portions.

15. The fixed quantity discharge squeeze container according to claim 3, wherein corner portion joint edge lines between the lateral support wall portions and a back wall portion arranged as facing to the squeeze face portion are edge lines having approximately an arc sectional shape of quarter round with larger curvature than that of the joint edge lines between the inclined linking face portions and the squeeze face portion or the lateral support wall portions.

16. The fixed quantity discharge squeeze container according to claim 4, wherein corner portion joint edge lines between the lateral support wall portions and a back wall portion arranged as facing to the squeeze face portion are edge lines having approximately an arc sectional shape of quarter round with larger curvature than that of the joint edge lines between the inclined linking face portions and the squeeze face portion or the lateral support wall portions.

17. The fixed quantity discharge squeeze container according to claim 7, wherein corner portion joint edge lines between the lateral support wall portions and a back wall portion arranged as facing to the squeeze face portion are edge lines having approximately an arc sectional shape of quarter round with larger curvature than that of the joint edge lines between the inclined linking face portions and the squeeze face portion or the lateral support wall portions.

18. The fixed quantity discharge squeeze container according to claim 1, wherein the inclined linking face portions are planar.

19. The fixed quantity discharge squeeze container according to claim 1, wherein the inclined linking face portions are concave.

20. The fixed quantity discharge squeeze container according to claim 1, wherein:

the inclined linking face portions are concave, widths of the inclined linking face portions are greater at center sections thereof than at lower and upper end portions thereof in the vertical direction, and the center sections of the inclined linking face portions are positioned laterally towards a center of the container relative the lower and upper end portions of the inclined linking face portions.

* * * * *